US005594326A

United States Patent [19]

Gilbert

[11] Patent Number: 5,594,326

[45] Date of Patent: Jan. 14, 1997

[54] SUB-RAIL VOLTAGE REGULATOR WITH LOW STAND-BY CURRENT AND HIGH LOAD CURRENT

[75] Inventor: Barrie Gilbert, Portland, Oreg.

[73] Assignee: Analog Devices, Inc., Norwood, Mass.

[21] Appl. No.: 484,824

[22] Filed: Jun. 7, 1995

[51] Int. Cl.[6] ..... G05F 3/16

[52] U.S. Cl. ..... 323/313; 323/315

[58] Field of Search ..... 323/312, 313, 323/315, 317; 327/535, 538, 539, 540; 330/257, 288

[56] References Cited

U.S. PATENT DOCUMENTS

| | | | |
|---|---|---|---|
| 4,383,223 | 5/1983 | Ulmer | 330/253 |
| 4,835,487 | 5/1989 | Doyle et al. | 323/315 |
| 4,866,312 | 9/1989 | Kearney et al. | 323/315 |
| 5,442,320 | 8/1995 | Kunst et al. | 330/267 |
| 5,453,680 | 9/1995 | Giolma et al. | 323/315 |

*Primary Examiner*—Matthew V. Nguyen

*Attorney, Agent, or Firm*—Marger, Johnson, et al.

[57] ABSTRACT

The sub-rail voltage generator includes three sections: an output stage having an output terminal that provides a sub-rail output voltage; a voltage divider network that includes two voltage nodes; and a current gain stage connected between the voltage nodes of the voltage divider and the output terminal of the output stage. The current gain stage includes two sections. The first section includes a first transistor connected between a respective voltage divider voltage node and the output terminal for sensing the output load current demanded at the output terminal. A current is produced in the first transistor responsive to a sourcing load current demanded at the output terminal. A current mirror is coupled to the first transistor to "mirror" the current through the first transistor. This mirrored current is provided to a first output transistor in the output stage as a first bias current. The first output transistor provides the demanded output current responsive to the first bias current. The second section of the current gain stage is the mirror image of the first section and is responsive to a sinking load current demanded at the output terminal.

20 Claims, 2 Drawing Sheets

SUB-RAIL VOLTAGE REGULATOR WITH LOW STAND-BY CURRENT AND HIGH LOAD CURRENT

BACKGROUND OF THE INVENTION

This invention relates generally to voltage supplies and more particularly to sub-rail voltage supplies.

Many applications require a voltage that is somewhere between the positive supply voltage ($V_{cc}$) and the negative or common supply ($V_{ss}$). In many cases this voltage is required to be midway between the positive an common supply voltages. In these cases, the voltage is referred to as a midpoint voltage and the circuit that generates the voltage a midpoint voltage generator. In general, however, these voltage generators can be referred to as "sub-rail" voltage generators because their output voltages are below the positive voltage rail.

An example of a midpoint voltage generator is shown in FIG. 1. The midpoint voltage generator of FIG. I includes a voltage divider network comprised of resistors R1 and R2 and diode-connected transistors Q1 and Q3. The voltage generator also includes an output stage comprised of transistors Q2 and Q4. The voltage divider network establishes two voltages: one at node 10, which is supplied to the base of transistor Q2, and another at node 12, which is supplied to the base of Q4. These voltages bias the respective output transistors to establish a quiescent current flowing through transistors Q2 and Q4. The transistors Q1 and Q2 compensate for the base to emitter voltage drops across transistors Q2 and Q4, respectively. The values of R1 and R2 are typically equal, but do not need to be. If they are equal, however, the voltage generator produces an output voltage $V_M$ that is at the mid-point between the two supply voltages, hence the name mid-point voltage generator.

The output of the midpoint voltage generator is supplied to an output terminal 14, to which a capacitive load $C_L$ and a resistive load $R_L$ is connected. A load current $I_L$ is shown flowing into the capacitive load, which represents the current demanded by the load, although shown as a sourcing current, the output current could be a sinking current as well, depending upon the demands of the load.

There are several problems with this voltage generator. The first is that the output impedance is too high for many applications. The output impedance is approximately equal to the parallel combination of the resistances seen looking into the emitters of Q2 and Q4, i.e., (R1 ||R2)/β. This high output impedance causes large fluctuations in the output voltage $V_M$ as the load current $I_L$ fluctuates. Therefore, the output voltage $V_M$ is not stable with variable loads or dynamic load currents.

Another problem with the voltage generator of FIG. 1 is that the amount of load current that it can supply is quite limited. The maximum load current ($I_{LMAX}$) that the circuit can supply to a grounded load is given by the following equation:

$$I_{LMAX}=[(V_{cc}-V_{BE})/R1]\times\beta,$$

where $V_{BE}$ is equal to the base to emitter voltage drop across transistor Q2 and β is the current gain of Q2. For example, if $V_{cc}$is 3 volts, β is equal to 100, and resistor R1 is approximately 60 KΩ , the load current $I_{MAX}$ is approximately equal to 330 μA. This amount of drive capability is inadequate for many applications.

An improvement on the basic mid-point voltage generator of FIG. 1 is shown in FIG. 2. This is essentially a special-purpose operation amplifier. The voltage generator of FIG. 2 includes a transonductance (gm) stage 14, which monitors the output voltage $V_M$ and compares it to a voltage at node 16 formed by the voltage divider network of R3 and R4. The gm stage 14 drives a Darlington pair of transistors Q5 and Q6. The transistor Q6 provides additional base drive to transistor Q5 thereby increasing the load current that can be supplied by the voltage generator. It is apparent that the voltage generator FIG. 2 is significantly more complex than the circuit of FIG. 1. In addition, this circuit consumes additional quiescent or stand-by current, which makes the circuit less desirable for low power applications. Moreover, the voltage generator of FIG. 2 may have stability problems with reactive loads due to the high open-loop gain of the opamp in the feedback path of the circuit.

Another approach is shown in FIG. 3. The voltage generator of FIG. 3 includes and additional emitter-follower transistors Q7 and Q8, which provide added base current to the output transistors Q9 and Q10, respectively. This circuit is an improvement over the voltage generator of FIG. 1 in that it provides greater current drive capability. However, it is not suited for low-voltage applications. The additional voltage drop across the added emitter-follower transistor (e.g., Q7) consumes a valuable fraction of the supply voltage. Low power applications typically require a smaller supply voltage since power is equal to the product of voltage and current. A typical supply voltage for these applications is three volts (3 V). The output voltage $V_M$ for a mid-point voltage generator would therefore be approximately 1.5 volts. Thus, the voltage drop across transistors Q7 and Q9 and resistor R5 must be less than 1.5 volts. This may not be possible because the voltage drop across each base to emitter junction ($V_{BE}$) Of the two transistors can range from approximately 0.7 V to 1.0 V. Therefore the drop across these two transistors itself can potentially exceed the allowable headroom, this does not even consider the voltage drop across R5 or the tolerance in the supply voltage itself. As a result, the voltage generator of FIG. 3 is not well suited for low power applications.

Accordingly, a need remains for a sub-rail voltage supply with low quiescent current, high load currents, and which is well suited for low voltage applications.

SUMMARY OF THE INVENTION

It is, therefore, an object of the invention to overcome the limitations of the prior art sub-rail voltage supply generators.

The sub-rail voltage generator according to the invention includes three components: an output stage having an output terminal for supplying a sub-rail voltage, a voltage divider network, and a current gain stage connected between the voltage divider network and the output terminal. The gain stage provides a first bias current to the output stage that is responsive to a sinking load current demanded at the output terminal and a second bias current to the output stage that is responsive to a sourcing load current demanded at the output terminal. The output stage supplies the demanded load currents responsive to the first and second bias currents provided thereto.

The current gain stage according to the invention includes two sections that are mirror images of each other. The first section is coupled between a first node in the voltage divider network and a first output transistor in the output stage. The first section includes a first transistor connected between the first node in the voltage divider network and the output terminal. The first transistor senses or detects additional sourcing load current demanded at the output terminal. A diode-connected transistor is connected in series with the first transistor so that the current flowing through the first transistor flows through the diode-connected transistor. A current mirror transistor is connected to the diode-connected transistor so that the current through the current mirror transistor "mirrors" the current through the diode-connected transistor. This mirrored current is then provided to the base of the first output transistor of the output stage. Thus, when additional sourcing load current is demanded at the output terminal, additional base drive is provided to the base of the first output transistor by the current mirror transistor. This additional base drive is referred to as the first bias current above.

The second section of the current gain stage is the mirror image of the first section. The second section includes a second transistor that is connected between a second node in the voltage divider network and the output terminal for sensing or detecting a sinking load current demanded at the output terminal. A second diode-connected transistor is connected a series with the second transistor so that the current flowing through the second transistor flows through the second diode-connected transistor. A second current mirror transistor is connected between the second diode connected transistor and the base of a second output transistor in the output stage. Thus, in the same manner as described above, when the second transistor detects additional sinking load current demanded at the output terminal, the second current mirror transistor provides additional base current to the second output transistor so that the output transistor can accommodate this additional current demand.

The foregoing and other objects, features and advantages of the invention will become more readily apparent from the following detailed description of a preferred embodiment of the invention which proceeds with reference to the accompanying drawings.

DETAILED DESCRIPTION

Figure 1:
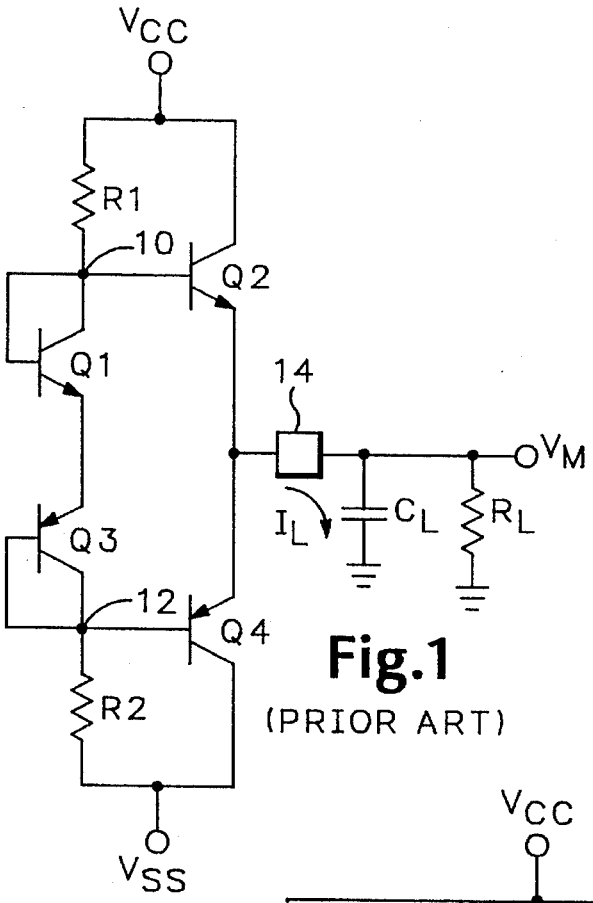
Fig.1 (PRIOR ART)
FIG. 1 is a prior art sub-rail voltage generator.
Figure 4:
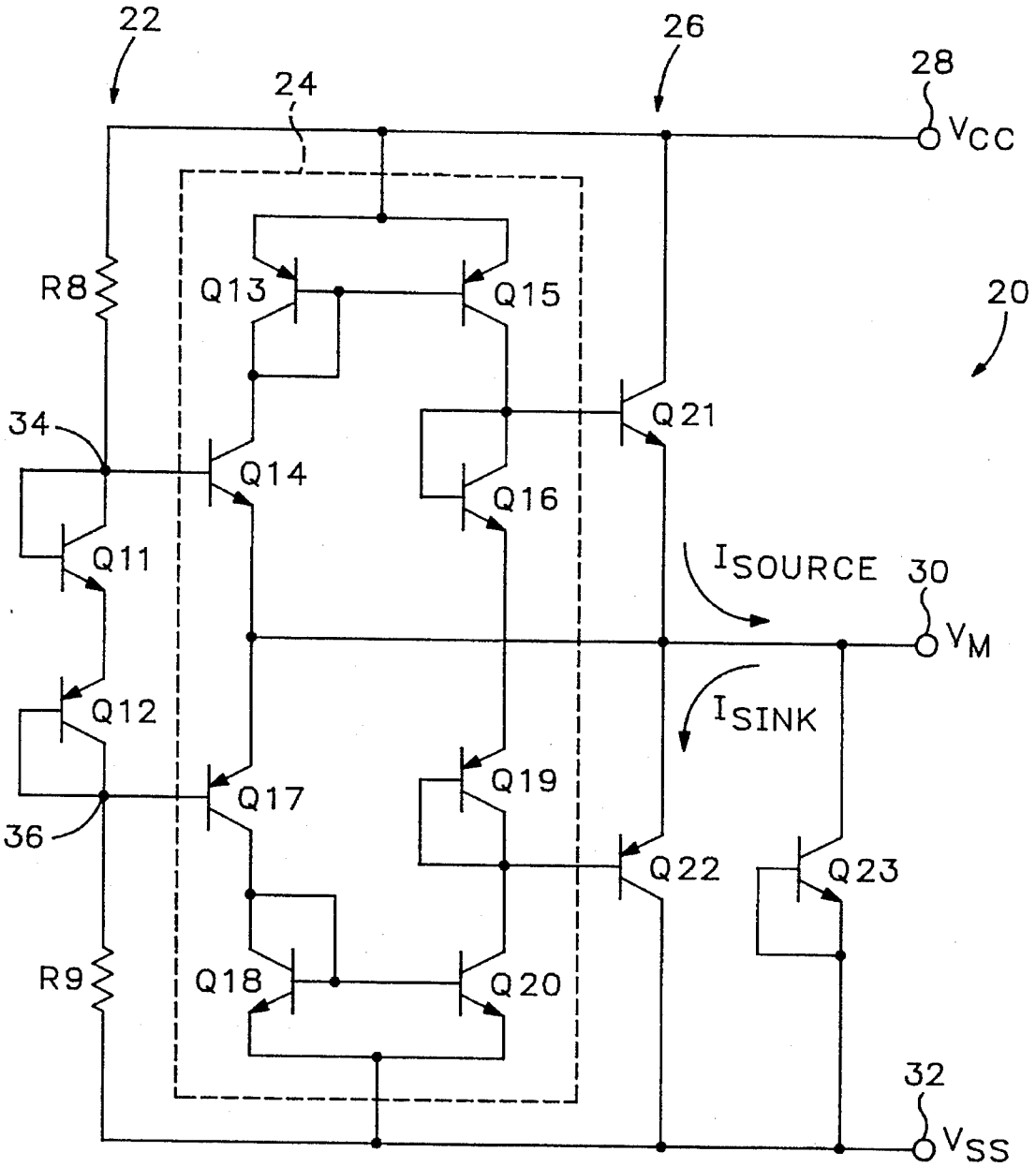
FIG. 4 is a sub-rail voltage generator according to the invention.

Referring now to FIG. 4, a sub-rail voltage generator according to the invention is shown generally at 20. The voltage generator 20 is comprised of three components: a voltage divider network shown generally at 22, a current gain stage 24, and an output stage shown generally at 26. Both the voltage divider network 22 and the output stage 26 are essentially identical to those shown in FIG. 1. Not shown in any of the prior art voltage generators is the current gain stage 24. Although the voltage divider network 22 and the output stage 26 are disclosed in the prior art, they will both be briefly described hereinbelow.

The voltage divider network 22 includes resistors R8 and R9 as well as diode-connected transistors Q11 and Q 12. The diode-connected transistors are included, as in the prior art, to compensate for a single base-to-emitter voltage drop ($V_{BE}$) in the remaining circuit. Although diode-connected transistors are shown, any equivalent device which produces a diode voltage drop there across can be used in place thereof. As should be apparent by comparing FIGS. 3 and 4, the current gain stage 24 consumes only a single $V_{BE}$ for each half of the circuit, while the circuit in FIG. 3 consumes two $V_{BE}$ voltage drops. For this reason, the voltage generator 20 is better suited for low voltage and thus low power applications.

The output stage 26 is a classic push-pull output stage, as used in the prior art voltage generators. The output stage includes a first NPN output transistor Q21 and a second PNP output transistor Q22. The first output transistor is connected between a supply voltage terminal 28 and the output terminal 30, while the second output transistor Q22 is connected between the output terminal 30 and a common or negative supply terminal 32. An additional diode-connected transistor Q23 is connected between the output terminal 30 and the supply terminal 32, which provides for electrostatic discharge (ESD) protection for the circuit 20. The transistor Q23 is not essential to the operation of the circuit, but will be included in actual applications where the voltage generator 20 could be exposed to electrostatic discharge, such as where the output terminal 30 is coupled to an output pad of an integrated circuit (IC), as in the preferred embodiment.

The current gain stage 24 includes two sections. The first section includes transistors Q13, Q14, Q15 and Q16. The second section includes transistors Q17, Q18, Q19, Q19, and Q20. The two sections are mirror images of each other, i.e., where the first section uses NPN transistors the second section uses PNP transistors and vice-versa. Each section will now be described in detail.

The first section includes transistor Q14, which is connected between a first node 34 in the voltage divider network and the output to terminal 30. The voltage divider network 22 provides a first bias voltage ($V_{B1}$) to the base of transistor Q14. The emitter of transistor Q14 is connected to the output terminal 30, which, under ideal circumstances, is at a constant voltage $V_M$. However, when additional sourcing load current ($I_{source}$) is demanded at the output terminal 30, the sub-rail output voltage $V_M$ has a tendency to drop slightly. A sourcing load current, as shown in FIG. 4, is one that flows out of the circuit into the load. This is in contrast to a sinking load current that flows into the circuit from the load. This slight drop in voltage produces a corresponding increase in the base-to-emitter voltage of transistor Q14. The current through the transistor Q14 is increased thereby, responsive to the drop in the output voltage $V_M$, because the collector current of Q 14 is a function of the base-to-emitter voltage $V_{BE}$.

A diode-connected transistor Q13 is connected between the supply voltage terminal 28 and the collector of transistor Q14. A current mirror transistor Q15 is connected to the diode-connected transistor Q13 so that the voltage drop across the transistor Q13 is imposed on the base-to-emitter junction of the current mirror transistor Q15. Connected in this way, the current through the diode-connected transistor Q13 is "mirrored" in current mirror transistor Q15 because both have the same base-to-emitter voltage ($V_{BE}$). Thus, transistors Q13 and Q15 form a classic current mirror. In the preferred embodiment, the ratio of the emitter area of Q13 to the emitter area of Q15 is approximately 1:1. This are ratio produces a current in Q15 that is approximately equal to the current in Q13 because the current in each transistor is a function of their base-to-emitter voltage. Other non-unitary emitter area ratios, however, can be used.

The collector of transistor Q15 is connected to the base of transistor Q21 so that a portion of the current through the mirror transistor Q15 is supplied to the base of output transistor Q21 as a first bias current. An additional diode-connected transistor Q16 is connected to the base of transistor Q21 to shunt the remaining current away from the base of transistor Q21.

The operation of the first section is as follows. The first transistor Q14, as described above, produces a current responsive to a sourcing load current $I_{source}$ demanded at the output terminal 30. The current through transistor Q14 flows through diode-connected transistor Q13, which in turn is mirrored by current mirror transistor Q15. This mirrored current is then provided to the base of output transistor Q21 as a first bias current. This output transistor Q21 then provides the demanded sourcing load current responsive to the first bias current. Providing the demanded output current also causes the output voltage $V_M$ to return to its nominal voltage level.

The second section of the current gain stage 24 is the mirror image of the first, i.e., NPN transistors are substituted for PNP transistors and vice versa. The second section includes a second transistor Q17, which is connected between a second node 36 of the voltage divider network 22 and the output terminal 30. A diode-connected transistor Q18 is connected between the collector of Q17 and a common or negative supply terminal 30. Thus, the current flowing through the second transistor Q17 flows through the diode-connected transistor Q18. The diode-connected transistor Q18 is connected to a current mirror transistor Q20 so that the voltage across the base to emitter junction of Q18 is imposed across the base to emitter junction of transistor Q20. In this way, the current through Q18 is "mirrored" in current mirror transistor Q20. As in the current mirror of the first section, the emitter are ratio of Q18 to Q20 is unity in the preferred embodiment but not limited thereto. The collector of transistor Q20 is connected to the base of a second output transistor Q22 to provide a second bias current thereto. Finally, a diode-connected transistor Q19 is connected between the diode-connected transistor Q16 and the base of transistor Q22.

The second section operates in substantially the same way as the first section. The second section, however, is responsive to a sinking load current ($I_{SINK}$) demanded at the output terminal 30. As the sinking load current demanded at the output terminal increases, the output voltage $V_M$ will have a tendency to rise. As the voltage of $V_M$ increases, however, the base-to-emitter voltage across the second transistor Q17 increases, thereby increasing the current supplied to diode-connected transistor Q18. As the current through diode-connected transistor Q18 increases, so does the base-to-emitter voltage drop there across. This increased base-to-emitter voltage is impressed upon the base-to-emitter junction of transistor Q20, which produces a corresponding increase in the current through transistor Q20. The increased current through transistor Q20 provides additional base drive to the second output transistor Q22. This additional base drive allows transistor Q22 to sink the load current demanded at the output terminal and thereby bring the output voltage $V_M$ back to its nominal voltage.

Figure 3:
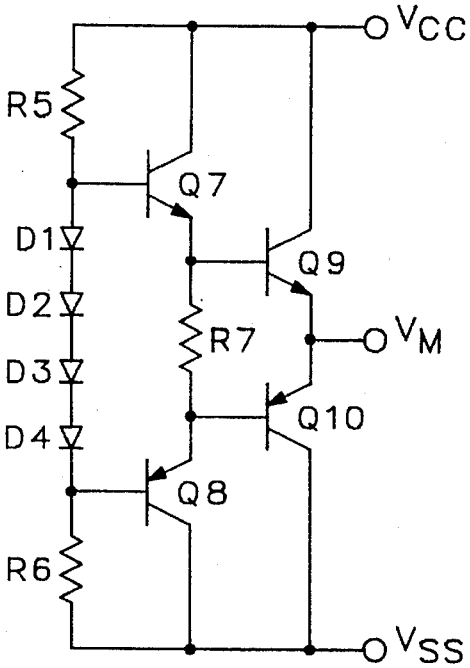
Fig.3 (PRIOR ART)
FIG. 3 is yet another prior art sub-rail voltage generator.
Figure 2:
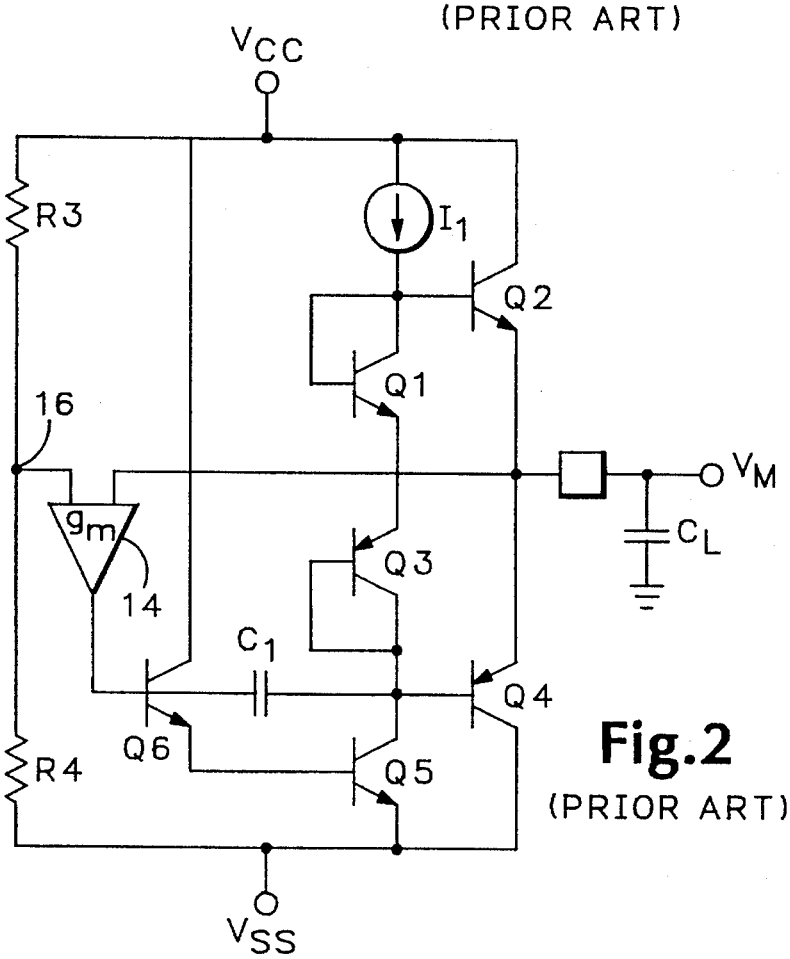
Fig.2 (PRIOR ART)
FIG. 2 is another prior art sub-rail voltage generator.

The sub-rail voltage generator according to the invention thus provides the additional current drive without the increased voltage requirements of the prior art circuit of FIG. 3. In addition, the voltage generator 20 is substantially less complex and does not suffer from the instability problems of the circuit of FIG. 2. Moreover, the circuit consumes less quiescent current than the circuit of FIG. 2. For these reasons the sub-rail voltage generator 20 is a significant improvement over the prior art.

Having described and illustrated the principles of the invention in a preferred embodiment thereof, it should be apparent that the invention can be modified in arrangement and detail without departing from such principles. For example, the voltage generator circuit 20 is not limited to bipolar implementations, equivalent circuits can be constructed using other semiconductor technologies. In addition, the values of R8 and R9 need not be equal but can be selected to appropriate values in order to set the output voltage at a desired point between the supply voltages. I claim all modifications and variations coming within the spirit and scope of the following claims.

I claim:

1. A voltage reference generator comprising:

an output stage having an output terminal for supplying a sub-rail voltage;

a voltage divider network; and a current gain stage connected between the voltage divider network and the output terminal of the output stage, the gain stage providing a first bias current to the output stage that is responsive to a sinking load current detected at the output terminal and a second bias current to the output stage that is responsive to a sourcing load current detected at the output terminal, the output stage being responsive to the first and second bias currents to supply the demanded load currents.

2. A voltage reference generator according to claim 1 wherein the current gain stage includes:

a first transistor coupled between the voltage divider network and the output terminal; and a current mirror coupled between the first transistor and the output stage for mirroring the current through the first transistor to produce the first bias current.

3. A voltage reference generator according to claim 2 wherein the current mirror includes:

a diode connected in series with the first transistor; and a mirror transistor having a first terminal coupled to the output stage for supplying the first bias current thereto, a second terminal coupled to the anode of the diode, and a third terminal coupled to a common voltage terminal.

4. A voltage reference generator according to claim 3 wherein the diode includes an NPN diode-connected transistor.

5. A voltage reference generator according to claim 2 wherein the current mirror includes:

a diode connected in series with the first transistor; and a mirror transistor having a first terminal coupled to the output stage for supplying the second bias current thereto, a second terminal coupled to the cathode of the diode, and a third terminal coupled to a supply voltage terminal.

6. A voltage reference generator according to claim 5 wherein the diode includes a PNP diode-connected transistor.

7. A voltage reference generator according to claim 2 wherein the first transistor includes an NPN transistor.

8. A voltage reference generator according to claim 2 wherein the first transistor includes a PNP transistor.

9. A voltage reference generator according to claim 1 further comprising an ESD diode connected between the output terminal and a common voltage terminal.

10. A voltage reference generator comprising:

a complementary output stage having an NPN transistor coupled between a supply voltage terminal and an output terminal and having a PNP transistor coupled between the output terminal and a common voltage terminal;

a voltage divider network having a first voltage terminal and a second voltage terminal; and a complementary current gain stage having a first input connected to the first voltage terminal, a second input connected to the second voltage terminal, a third input connected to the output terminal, a first output coupled to the NPN transistor to supply a first bias current thereto, the first bias current being responsive to an increase in current sourcing demand at the output terminal, and a second output coupled to the PNP transistor to supply a second bias current thereto, the second bias current being responsive to an increase in current sinking demand at the output terminal.

11. A voltage reference generator according to claim 10 wherein the complementary current gain stage includes:

a first transistor coupled between the first voltage terminal and the output terminal;

a first current mirror coupled to the first transistor for mirroring the current through the first transistor, the first current mirror coupled to the NPN transistor for supplying the first bias current thereto;

a second transistor coupled between the second voltage terminal and the output terminal; and a second current mirror coupled to the second transistor for mirroring the current through the second transistor, the second current mirror coupled to the PNP transistor for supplying the second bias current thereto.

12. A voltage reference generator according to claim 11 wherein the first current mirror includes:

a first diode connected in series with the first transistor; and a first mirror transistor having a first terminal coupled to the NPN transistor for supplying the first bias current thereto, a second terminal coupled to the cathode of the diode, and a third terminal coupled to a supply voltage terminal.

13. A voltage reference generator according to claim 12 wherein the complementary current gain stage further includes a diode connected in series with the first mirror transistor.

14. A voltage reference generator according to claim 11 wherein the second current mirror includes:

a second diode connected in series with the second transistor; and a second mirror transistor having a first terminal coupled to the PNP transistor for supplying the second bias current thereto, a second terminal coupled to the anode of the diode, and a third terminal coupled to the a common voltage terminal.

15. A voltage reference generator according to claim 14 wherein the complementary current gain stage further includes a diode connected in series with the second mirror transistor.

16. A voltage reference generator according to claim 15 wherein the diode includes a diode-connected transistor.

17. A voltage reference generator according to claim 10 wherein the voltage divider network includes:

a first resistor coupled between a supply voltage terminal and the first voltage terminal;

a second resistor coupled between a common voltage terminal and the second voltage terminal;

a first diode connected to the first voltage terminal; and a second diode connected between the first diode and the second voltage terminal.

18. A voltage reference generator according to claim 17 wherein the resistance of the first resistor is approximately equal to the resistance of the second resistor.

19. A voltage reference generator according to claim 17 wherein the resistance of the first resistor is not equal to the resistance of the second resistor.

20. A voltage reference generator according to claim 10 further comprising an ESD diode connected between the output terminal and a common voltage terminal.

* * * * *

UNITED STATES PATENT AND TRADEMARK OFFICE

CERTIFICATE OF CORRECTION

PATENT NO. : 5,594,326
DATED : Jan. 14, 1997
INVENTOR(S) : Gilbert

It is certified that error appears in the above-indentified patent and that said Letters Patent is hereby corrected as shown below:

Column 1, line 63, "$I_{MAX}$" should read --$I_{LMAX}$ --.

Signed and Sealed this

Seventh Day of September, 1999

*Attest:*

Q. TODD DICKINSON

*Attesting Officer*

*Acting Commissioner of Patents and Trademarks*